US008381370B2

(12) United States Patent
Higashinaka et al.

(10) Patent No.: US 8,381,370 B2
(45) Date of Patent: Feb. 26, 2013

(54) FUSION-BONDABLE HOOK-AND-LOOP FASTENER

(75) Inventors: Yukitoshi Higashinaka, Fukui (JP); Takayoshi Kaiko, Fukui (JP)

(73) Assignee: Kuraray Fastening Co., Ltd., Osaka-shi (JP)

( * ) Notice: Subject to any disclaimer, the term of this patent is extended or adjusted under 35 U.S.C. 154(b) by 201 days.

(21) Appl. No.: 12/738,915

(22) PCT Filed: Oct. 14, 2008

(86) PCT No.: PCT/JP2008/068546

§ 371 (c)(1),
(2), (4) Date: Jun. 10, 2010

(87) PCT Pub. No.: WO2009/054284

PCT Pub. Date: Apr. 30, 2009

(65) Prior Publication Data

US 2010/0287743 A1 Nov. 18, 2010

(30) Foreign Application Priority Data

Oct. 23, 2007 (JP) ..... 2007-275022

(51) Int. Cl.
*A44B 18/00* (2006.01)
*A47G 27/00* (2006.01)

(52) U.S. Cl. ..... 24/444; 24/306; 24/442; 24/448

(58) Field of Classification Search ..... 24/306, 24/443, 444, 682.1–685, 693, DIG. 49, 448, 24/442; 604/389, 391, 366, 365; 428/62, 428/100; 156/304.4, 157, 308.2, 309.6, 308.4, 156/156, 304.3
See application file for complete search history.

(56) References Cited

U.S. PATENT DOCUMENTS 3,325,323 A * 6/1967 Forkner ..... 156/72
3,391,434 A * 7/1968 Girard ..... 24/444

(Continued)

FOREIGN PATENT DOCUMENTS

DE 1 535 994 11/1972
JP 57 118718 7/1982

(Continued)

OTHER PUBLICATIONS

Extended European Search Report issued Oct. 22, 2010, in Patent Application No. 08842502.0.

*Primary Examiner* — Robert J Sandy
*Assistant Examiner* — Abigail E Morrell
(74) *Attorney, Agent, or Firm* — Oblon, Spivak, McClelland, Maier & Neustadt, L.L.P.

(57) ABSTRACT

Provided is a fusion-bondable surface fastener which includes a surface fastener and a fusion-bondable film partly fixed to the surface fastener. The surface fastener includes a base fabric made of a knitted or woven fabric and has fastening elements outwardly extending from base fabric, where the base fabric has a first region, a second region and a third region each of which have fastening elements. In the first region, the fastening elements are overlaid with the fusion-bondable film and the fusion-bondable film is fusion-bonded to the surface fastener. In the second region the fastening elements are overlaid with the fusion-bondable film and the fusion-bondable film is not fusion-bonded to the surface fastener In the third region the fastening elements are not overlaid with the fusion-bondable film. The first region and the second region form a fusion-bondable area.

11 Claims, 2 Drawing Sheets

U.S. PATENT DOCUMENTS

| | | | | |
|---|---|---|---|---|
| 3,711,349 | A * | 1/1973 | Snyder et al. | 156/157 |
| 4,755,401 | A * | 7/1988 | Friedrich et al. | 428/17 |
| 4,769,895 | A * | 9/1988 | Parkins | 29/450 |
| 4,842,916 | A * | 6/1989 | Ogawa et al. | 428/100 |
| 5,191,692 | A * | 3/1993 | Pacione | 29/423 |
| 5,902,427 | A | 5/1999 | Zinke et al. | |
| 6,083,596 | A * | 7/2000 | Pacione | 428/62 |
| 6,393,673 | B1 * | 5/2002 | Kourtidis et al. | 24/304 |
| 6,701,580 | B1 * | 3/2004 | Bandyopadhyay | 24/16 R |
| 6,797,353 | B1 * | 9/2004 | Pacione | 428/62 |
| 7,185,465 | B2 * | 3/2007 | Pacione | 52/311.2 |
| 7,185,473 | B2 * | 3/2007 | Pacione | 52/747.11 |
| 7,194,843 | B2 * | 3/2007 | Pacione | 52/552 |
| 7,407,496 | B2 * | 8/2008 | Petersen | 604/390 |
| 7,682,681 | B2 * | 3/2010 | Allison et al. | 428/95 |
| 2002/0114909 | A1 | 8/2002 | Aiello | |
| 2002/0136846 | A1 * | 9/2002 | Prevost | 428/17 |
| 2008/0078073 | A1 | 4/2008 | Cheng | |

FOREIGN PATENT DOCUMENTS

| | | |
|---|---|---|
| JP | 11 181372 | 7/1999 |
| JP | 2001 070011 | 3/2001 |
| JP | 2002 000314 | 1/2002 |
| JP | 2002 223818 | 8/2002 |
| JP | 3127668 | 12/2006 |
| WO | WO 00/64296 | 11/2000 |

* cited by examiner

FUSION-BONDABLE HOOK-AND-LOOP FASTENER

TECHNICAL FIELD

The present invention relates to a surface fastener which is fusion-bondable to an adherend by an ultrasonic (high frequency) fusion bonding or a thermal fusion bonding.

BACKGROUND ART

Surface fasteners are widely used in articles for domestic and industrial use. The great advantage of the surface fastener bonded to an adherend is a detachable fastening of an object to the adherend. The surface fastener is also used to join two pieces of adherends. For example, two pieces of carpets can be joined side-by-side by fixing a first surface fastener onto the back surface of one of carpets so as to allow the first surface fastener to outwardly protrude from the carpet, fixing a second surface fastener, which has fastening elements cooperating with the first surface fastener, onto the back surface of the other carpet, and then engaging the protruded portion of the first surface fastener and the second surface fastener.

Several methods have been proposed to fix a surface fastener onto the back surface of an adherend (for example carpet). A sewable surface fastener having a base fabric made of cloth is attached to the adherend by stitches made with thread, if the adherend is sewable. However, the attachment by sewing is not applicable to a plastic or metallic adherend and in such cases an adhesive bonding or fusion bonding is needed. Even when the adherend is sewable, the attachment by sewing is not applicable to an excessively thick adherend. If attached by sewing, the threads in stitches are shown distinctly from the surface of the adherend to likely spoil the appearance.

To eliminate the above drawbacks, a surface fastener with stickiness (broad meaning inclusive of adhesiveness and fusion-bonding ability) has been proposed. For example, Patent Document 1 proposes a surface fastener for use as a closure of diapers, which has a sticky layer on part of its surface. In Patent Document 2, a surface fastener in which a surface fastener layer (are having fastening elements) and a sticky layer are placed side by side is proposed.

Patent Document 1: JP 11-181372A

Patent Document 2: JP 3127668(U)

DISCLOSURE OF THE INVENTION

Known sticky surface fasteners have a structure in which a fastening element area and a sticky area are formed on a base fabric. This structure is obtained by forming an area having fastening elements and an area having no fastening element on a base fabric, and then, providing a sticky material such as pressure sensitive adhesives and sticky films on the base fabric exposed in the area having no fastening element. Therefore, both the area having fastening elements and the area having no fastening element must be formed on the base fabric, thereby reducing the production efficiency. If the base fabric of surface fastener is extremely rough, a high technique is required to provide a pressure sensitive adhesive in uniform layer, reducing the production efficiency.

Patent Document 2 also discloses a surface fastener which is produced by placing a sticky layer (adhesive film) on a part of the fastening element area and pressing the sticky layer to make the fastening elements beneath the sticky layer flat, thereby press-bonding the sticky layer onto the base fabric via the flat fastening element layer. To obtain the surface fastener having such a structure, a thermally fusion-bondable area must be first formed by press and fusion-bonding the adhesive film to the base fabric via the fastening elements beneath the adhesive film. In addition, the adhesive film must be heat-melted again at the time the obtained fusion-bondable surface fastener is fusion-bonded to an adherend. Therefore, the thermally fusion-bondable area is subject to the thermal fusion-bonding operation twice, this reducing the amount of fusion-bondable material available in the bonding to the adherend by half. Thus, the efficiency of producing the surface fastener cannot be high and the thermal fusion bonding between the surface fastener and the adherend is not high.

An object of the present invention is to solve the above problems in prior art and provide a fusion-bondable surface fastener which is securely and unitarily fusion-bondable to an adherend by the use of a small amount of fusion-bondable material. Thus, the present invention relates to a fusion-bondable surface fastener which comprises a surface fastener and a fusion-bondable film partly fixed to the surface fastener, wherein the surface fastener comprises a base fabric made of a knitted or woven fabric and fastening elements outwardly extending from the base fabric;

the fusion-bondable surface fastener has a region A in which the fastening elements are overlaid with the fusion-bondable film and the fusion-bondable film is fusion-bonded to the surface fastener; a region B in which the fastening elements are overlaid with the fusion-bondable film and the fusion-bondable film is not fusion-bonded to the surface fastener; and a region C in which the fastening elements are not overlaid with the fusion-bondable film; and the region A and the region B forms a fusion-bondable area.

BEST MODE FOR CARRYING OUT THE INVENTION

Figure 1:
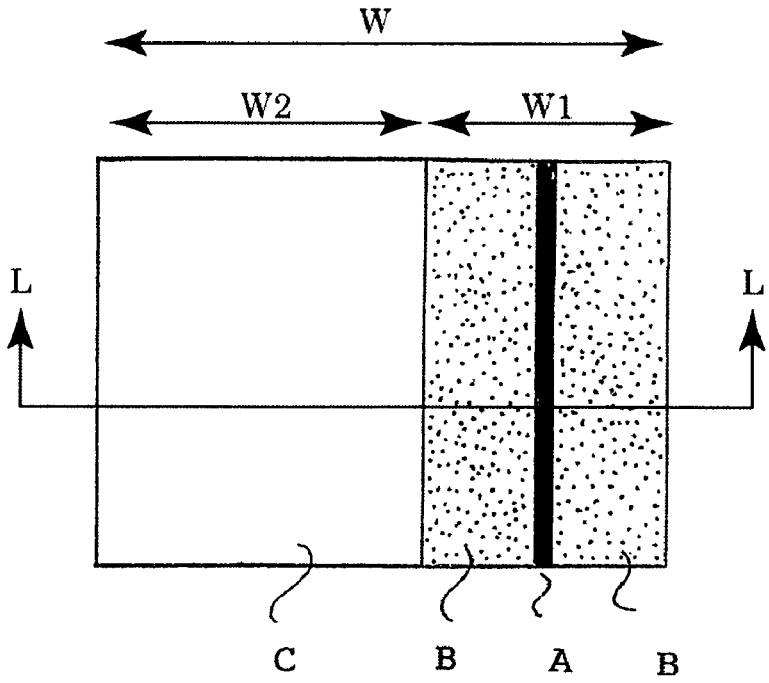
FIG. 1 is a schematic plan view of a fusion-bondable surface fastener of the present invention in which a fusion-bondable film is partly fusion-bonded in line to a surface fastener.

The fusion-bondable surface fastener of the invention is produced from any of a known cloth surface fastener having hook (or mushroom) fastening elements, a known cloth surface fastener having loop fastening elements, and a known cloth surface fastener having hook and loop fastening elements. The cloth surface fasteners available from Kuraray Fastening Co., Ltd., YKK Corporation, Aplix Fasteners Inc., Velcro Industries, etc. are widely usable. The base fabric and the fastening elements of the surface fastener are generally made of polyamide fibers or polyester fibers, and also made of polyolefin fibers such as polypropylene fibers and other types of fibers. The fiber forming the base fabric and the fiber forming the fastening elements may be the same or different type. The base fabric may be a woven fabric or a knitted fabric, with the woven fabric being preferred in view of mechanical strength.

The fusion-bondable film used in the present invention is preferably a polyamide fusion-bondable film (for example, Daiamide Film 2401 manufactured by Daicel FineChem Ltd.), a polyester fusion-bondable film (for example, Elphan PH-402 manufactured by Nihon Matai Co., Ltd.), and a polyurethane fusion-bondable film (for example, Elphan UH-203 manufactured by Nihon Matai Co., Ltd.) in view of the formability and adhesion to the surface fastener. The polyamide fusion-bondable film is particularly preferred if the base fabric and the fastening elements of the surface fastener are made of nylon fibers.

The thickness of the fusion-bondable film is preferably 0.05 to 1.0 mm in view of formability, and preferably 0.10 to 0.3 mm, particularly about 0.2 mm if the adherend is a floor mat having a thickness of about 10 mm. If a higher adhesion strength is needed, the fusion-bondable film may be superposed in two or three layers. The fusion-bondable films may be also superposed in layers to obtain a desired thickness. The melting point of the fusion-bondable film is preferably 80 to 140° C. and more preferably 100 to 120° C. in view of formability.

The fusion-bondable film is partly fusion-bonded to the base fabric and/or the fastening elements of the surface fastener by an ultrasonic (high frequency) fusion bonding using an ultrasonic sewing machine, an ultrasonic roller, etc. or a thermal fusion bonding using a hot press, a hot roller, etc. The fusion-bondable film is preferably fusion-bonded in line (straight line or curved line) or in spots (circular spots, elliptical spots, polygonal spots, irregular spots, etc.). For example, an ultrasonic continuous bonding machine (FM-1511 manufactured by FM Corporation) is preferably used because of easiness of partial fusion bonding in spots and lines.

For example, the fusion-bondable film is fixed to the surface fastener by overlaying the fusion-bondable film on the region of the surface having the fastening elements where the fusion-bondable area is to be formed, and then, fusion-bonding the fusion-bondable film to the base fabric and/or the fastening elements of the surface fastener in lines or spots using an ultrasonic continuous fusion-bonding machine.

The region A and the region B form a fusion-bonding area when the fusion-bondable surface fastener is fusion-bonded to an adherend. The total area of the region A and the region B is determined so that the fusion-bonding strength between the surface fastener and the adherend is larger than the engaging strength between the fastening elements in the region C and the cooperating fastening elements.

A schematic plan view of an example of the fusion-bondable surface fastener of the invention is shown in FIG. 1. In FIG. 1, A represents a region A in which the fusion-bondable film is fusion-bonded to the base fabric and/or the fastening elements of the surface fastener, B represents a region B in which the fusion-bondable film simply overlies the fastening elements without fusion-bonding to the base fabric and/or the fastening elements of the surface fastener, and C represents a region C in which the fusion-bondable film is not present and the fastening elements are exposed. If the width W of the surface fastener is 60 mm, for example, the total width W1 of the region A and the region B is preferably about 15 to 45 mm and the width W2 of the region C is preferably about 45 to 15 mm, more preferably W1 is 25 to 35 mm and W2 is 35 to 25 mm. Namely, the ratio of the area of the region C and the total area of the region A and the region B is preferably 1:3 to 3:1 and more preferably 5:7 to 7:5. With such an area ratio, the fusion-bonding strength can be larger than the engaging strength as mentioned above. When the fusion-bondable film is fusion-bonded in two or more lines or in two or more spots, the area of the region A is the total area of the fusion-bonded line portions or the fusion-bonded spot portions.

If fusion-bonded in line or lines, as shown in FIG. 1, only one fusion-bonded region A or two or three fusion-bonded regions A may be formed nearly at the widthwise center of the fusion-bondable film. However the position of the fusion-bonded region A is not particularly limited. The width of the fusion-bonded region A (total width when fusion-bonded in two or three lines) is preferably 0.5 to 8 mm and more preferably 0.8 to 5 mm. The fusion-bonded region A formed by the fusion bonding in line may be a straight or curved line and may be a continuous or broken line.

If fusion-bonded in dots, the area of each fusion-bonded dot is preferably 0.3 to 10 $mm^2$ and more preferably 0.5 to 5 $mm^2$. It is preferred that the fusion-bonded dots are arranged in a straight or curved line with intervals of 1 to 5 mm. The fusion-bonded dots are more preferably arranged in two or more parallel rows and are particularly preferably scattered throughout nearly the whole surface of the fusion-bondable film because the fusion-bondable film is fixed to the surface fastener enough to make the operation of fusion-bonding the fusion-bondable surface fastener to an adherend easy.

The area of the region A is preferably 1 to 20% and particularly preferably 2 to 18% of the total area of the region A and the region B. The region A is provided so as to fix the fusion-bondable film placed on the fastening elements to the surface fastener and it is sufficient for the purpose that both are partly fusion-bonded to each other so as not to easily separate.

Figure 2:
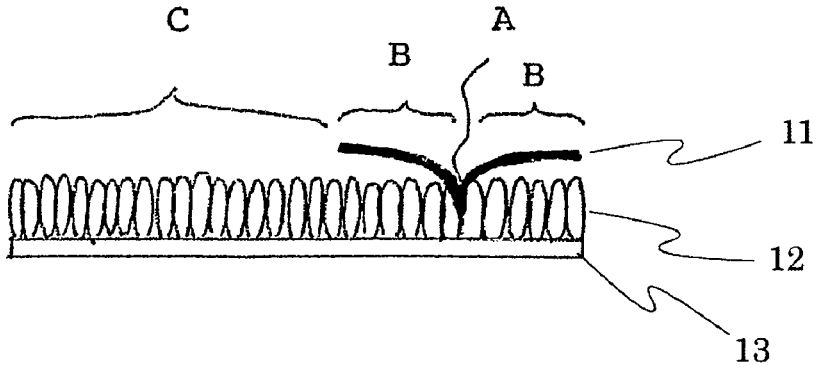
FIG. 2 is a cross-sectional view taken along the line L-L of FIG. 1.

A schematic cross-sectional view taken along the line L-L in FIG. 1 is shown in FIG. 2. As shown in FIG. 2, the fusion-bondable film 11 may be fusion-bonded to only the fastening elements 12. Alternatively the fusion-bondable film 11 may be fusion-bonded to the base fabric 13 or both the fastening elements 12 and the base fabric 13. It is not needed to firmly fusion-bond the fusion-bondable film to the surface fastener, because it is sufficient for the fusion-bondable film to form the fusion-bondable area on the surface fastener up to the time the fusion-bondable surface fastener is fusion-bonded to an adherend. If the existing density of the fastening elements is high, the fusion-bondable film is fusion-bonded mainly to the fastening elements, thereby being fixed to the surface fastener. If the existing density is low, the fusion-bondable film is fusion-bonded mainly to the base fabric, thereby being fixed to the surface fastener.

The fastening elements and the base fabric are not needed to melt. The overlying fusion-bondable film melts and the molten polymer penetrates between the fastening elements and into the base fabric to complete the fixation by fusion bonding.

The shape of the fusion-bondable surface fastener is not limited to a tape shape and also includes a rectangular shape, a circular shape, a star shape and other shapes. According to the present invention, the fusion-bondable area can be easily formed in any shapes.

The adherend to which the fusion-bondable surface fastener of the invention is fusion-bonded by an ultrasonic (high frequency) fusion-bonding or a thermal fusion-bonding may include a nonwoven fabric, a woven fabric, a back coat layer or a back coat sheet which are used as the liner or base fabric of floor mat, etc., with a nonwoven fabric being particularly preferred because the anchor effect due to the impregnated molten polymer is obtained. The nonwoven fabric and woven fabric may be made of polyester fibers such as polyethylene terephthalate fibers and polybutylene terephthalate fibers; polyolefin fibers such as polypropylene fibers and polyethylene fibers; or nylon fibers such as nylon 6 fibers and nylon 66 fibers. The back coat layer or back coat sheet may be made of resins mentioned above. The floor mat to be joined by the fusion-bondable surface fastener of the invention may include domestic floor mat, office floor mat, and floor mat for use in hotel, commercial building, airplane, automobile and ship. The fusion-bondable surface fastener of the invention is particularly suitable for joining two or more pieces of floor mats with complicated shapes as in the case of automobile floor mat, etc.

EXAMPLES

The embodiments and effects of the present invention will be described in more detail with reference to the examples and comparative examples. However, it should be noted that the scope of the present invention is not limited to the following examples.

Measurement of Fusion-Bonding Strength and Engaging Strength

Measured according to JIS L 3416 using a constant extension tensile tester of auto-recording type (SG-500 manufactured by Shimadzu Corporation). The peeling test was conducted at an extension speed of 300 mm/min and each strength was calculated from the strength (peel load) at peel.

Example 1

Figure 3:
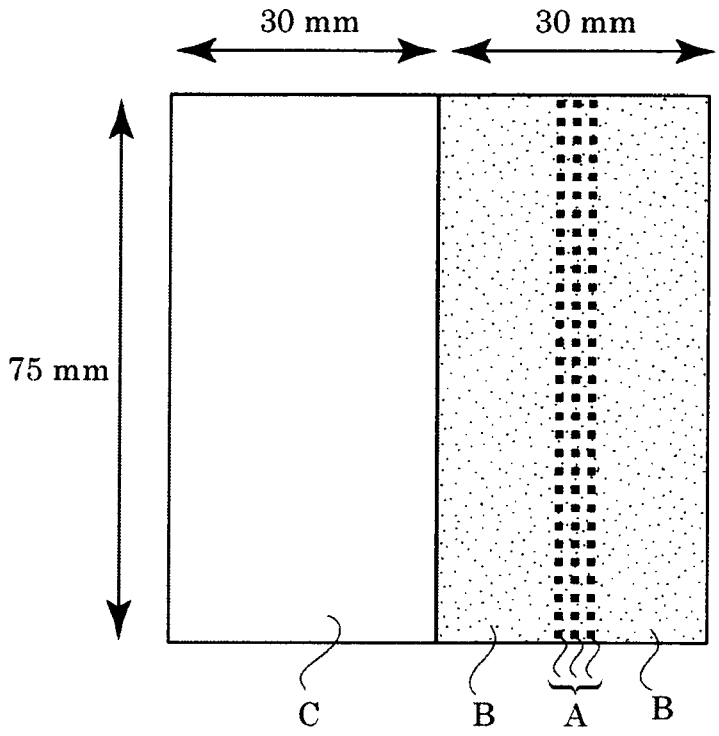
FIG. 3 is a schematic plan view of the fusion-bondable surface fastener produced in Example 1.

A polyamide fusion-bondable film (2401 manufactured by Daicel FineChem Ltd., fusion-bonding temperature: 110° C., thickness: 0.2 mm, width: 30 mm, length: 75 mm) was placed on the widthwise right half of a woven loop surface fastener (B10000 manufactured by Kuraray Fastening Co., Ltd.) with a width of 60 mm and a length of 75 mm. The widthwise central portion of the fusion-bondable film was fusion-bonded in dots to the loop fastening elements by using an ultrasonic sewing machine (FM-1511 manufactured by FM Corporation), to obtain a fusion-bondable loop surface fastener of the invention. The schematic plan view of the obtained fusion-bondable loop surface fastener is shown in FIG. 3. The size of each dot was 1 mm×1 mm and the dot interval was 2 mm. The dots were aligned along the lengthwise direction and in rows of three with intervals of 0.5 mm. The area fusion-bonded in dots (dots mentioned above) is the region A, the area in which the fusion-bondable film overlies but is not fusion-bonded is the region B, and the area in which the fusion-bondable film does not overlie and the fastening elements are exposed is the region C. The area of the region A is 0.75 $cm^2$ which was 3.3% of the total area (22.5 $cm^2$) of the region A and the region B. The ratio of the area of the region C (22.5 $cm^2$) and the total area of the region A and the region B was 1:1.

Figure 4:
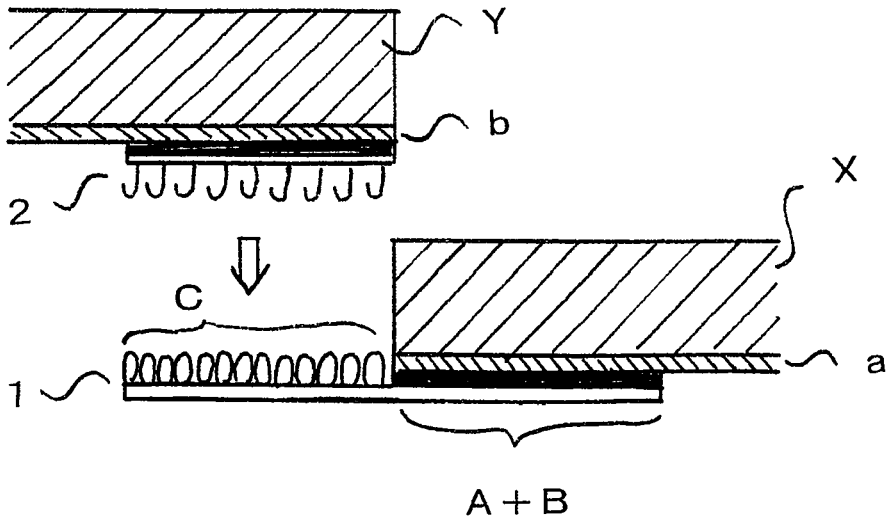
FIG. 4 is a schematic cross-sectional view showing a joint portion for joining two pieces of carpets using the fusion-bondable surface fastener of the present invention.

As shown in FIG. 4, the region A and the region B (fusion-bondable area) of the obtained fusion-bondable loop surface fastener 1 were superposed on the PET nonwoven fabric a on the back side of a floor mat carpet X, while allowing the portion having no fusion-bondable film (region C) to protrude from the edge of the nonwoven fabric a. The superposed portion was then hot-pressed at 160° C. for 30 s, to fusion-bond the fusion-bondable loop surface fastener 1 to the floor mat carpet X.

Separately, as shown in FIG. 4, using an ultrasonic sewing machine the fusion-bondable film mentioned above was fusion-bonded in line (line width: 3 mm) at its central portion to the back side of a woven hook surface fastener (A03800 manufactured by Kuraray Fastening Co., Ltd.) with a width of 30 mm and a length of 75 mm, to obtain a fusion-bondable hook surface fastener 2.

The fusion-bondable hook surface fastener 2 was superposed to the end portion of the PET nonwoven fabric b on the back side of a floor mat carpet Y via the fusion-bondable film. The superposed portion was then hot-pressed at 160° C. for 30 s, to fusion-bond the fusion-bondable hook surface fastener 2 to the floor mat carpet Y. As shown in FIG. 4, the hook surface fastener 2 is fixed to the end portion of the back side of the floor mat carpet Y with the exposed hook fastening elements extending downwardly.

As shown in FIG. 4, the hook fastening elements in the end portion of the floor mat carpet Y was pressed onto the loop fastening elements (region C) outwardly protruding from the edge of the floor mat carpet X to engage both the fastening elements with each other, thereby joining the floor mat carpet X and the floor mat carpet Y.

The fusion-bonding strength between the fusion-bonded area of the loop surface fastener 1 (region A+region B) and the floor mat carpet X was 4.4 kg/cm, and the engaging strength between the loop fastening elements (region C) and the hook fastening elements was 0.2 kg/cm. The fusion-bonded area of the loop surface fastener 1 was not broken even after repeating the engagement-disengagement operation 50 times.

Comparative Example 1

The widthwise right half of a woven loop surface fastener (width: 60 mm, length: 75 mm) as used in Example 1 was hot-pressed using a flat hot press machine at 160° C. for 30 s to make the loop fastening elements flat. A fusion-bondable film as used in Example 1 was placed on the flat loop fastening elements and the whole surface of the fusion-bondable film was hot-pressed at 130° C. for 30 s by a flat hot press machine, to fusion-bond the fusion-bondable film to the surface fastener via the flat loop fastening elements.

Two pieces of floor mat carpets were joined in the same manner as in Example 1 except for using the obtained fusion-bondable loop surface fastener. The fusion-bonding strength was 2.4 kg/cm and the engaging strength was 0.2 kg/cm. The fusion-bonded area of the fusion-bonded loop surface fastener was peeled off from the floor mat carpet after repeating the engagement-disengagement operation 30 times.

The engagement-disengagement operation was repeated after varying the thickness of the fusion-bondable film and the fusion bonding conditions. It was found that a thickness of 0.5 mm and a fusion bonding at 160° C. for 60 s were needed to avoid the peel off. With such a fusion bonding, however, the molten polymer penetrated into the surface fastener and the floor mat carpet. Therefore, the surface fastener and the floor mat carpet become extremely hard to exhibit uncomfortable hand and feeling. In addition, a long fusion-bonding time was required to decrease the production efficiency.

INDUSTRIAL APPLICABILITY

In the fusion-bondable surface fastener of the invention, the fusion-bondable film is partly fixed by fusion bonding to the fastening elements or the base fabric. Therefore, the fusion-bondable surface fastener is easily produced from a known cloth surface fastener such as a hook (mushroom) surface fastener, a loop surface fastener and a hook/loop surface fastener. The fusion-bondable area is extremely easily and efficiently formed and the fusion-bondable material is effectively used in the fusion bonding with an adherend. Therefore, the fusion-bonding strength between the surface fastener and the adherend is improved. The fusion-bondable surface fastener of the invention is particularly effective for joining carpets, etc.

What is claimed is:

1. A fusion-bondable surface fastener, which comprises a surface fastener and a fusion-bondable film partly fixed to the surface fastener, wherein the surface fastener comprises a base fabric made of a knitted or woven fabric;

the base fabric comprises a first region, a second region and a third region;

the first region, the second region and the third region each have fastening elements extending outwardly therefrom;

in the first region the fastening elements are overlaid with the fusion-bondable film and the fusion-bondable film is fusion-bonded to the surface fastener;

in the second region the fastening elements are overlaid with the fusion-bondable film and the fusion-bondable film is not fusion-bonded to the surface fastener;

in the third region the fastening elements are not overlaid with the fusion-bondable film; and the first region and the second region form a fusion-bondable area.

2. The fusion-bondable surface fastener of claim 1, wherein a fusion-bonding strength between an adherend to be fusion-bonded to the fusion-bondable surface fastener and the fusion-bondable area is higher than an engaging strength between the fastening elements of the third region and cooperating fastening elements to engage with the fastening elements.

3. The fusion-bondable surface fastener of claim 1, wherein the fusion-bondable film is fusion-bonded in line or lines to the surface fastener in the first region.

4. The fusion-bondable surface fastener of claim 1, wherein the fusion-bondable film is fusion-bonded in dots to the surface fastener in the first region.

5. The fusion-bondable surface fastener of claim 1, wherein the fusion-bondable film comprises at least one polymer selected from the group consisting of a polyamide fusion-bondable polymer, a polyester fusion-bondable polymer and a polyurethane fusion-bondable polymer and has a thickness of about 0.05 to 1.0 mm.

6. The fusion-bondable surface fastener of claim 2, wherein the fusion-bondable film is fusion-bonded in line or lines to the surface fastener in the first region.

7. The fusion-bondable surface fastener of claim 2, wherein the fusion-bondable film is fusion-bonded in dots to the surface fastener in the first region.

8. The fusion-bondable surface fastener of claim 2, wherein the fusion-bondable film comprises at least one polymer selected from the group consisting of a polyamide fusion-bondable polymer, a polyester fusion-bondable polymer and a polyurethane fusion-bondable polymer and has a thickness of about 0.05 to 1.0 mm.

9. The fusion-bondable surface fastener of claim 3, wherein the fusion-bondable film comprises at least one polymer selected from the group consisting of a polyamide fusion-bondable polymer, a polyester fusion-bondable polymer and a polyurethane fusion-bondable polymer and has a thickness of about 0.05 to 1.0 mm.

10. The fusion-bondable surface fastener of claim 4, wherein the fusion-bondable film comprises at least one polymer selected from the group consisting of a polyamide fusion-bondable polymer, a polyester fusion-bondable polymer and a polyurethane fusion-bondable polymer and has a thickness of about 0.05 to 1.0 mm.

11. A method for joining a first adherend and a second adherend with a first fusion-bondable surface fastener and a second fusion-bondable surface fastener, wherein the first surface fastener comprises a surface fastener and a fusion-bondable film partly fixed to the surface fastener;

the first surface fastener comprises a base fabric made of a knitted or woven fabric;

the base fabric comprises a first region, a second region and a third region;

the first region, the second region and the third region each have fastening elements extending outwardly therefrom;

in the first region the fastening elements are overlaid with the fusion-bondable film and the fusion-bondable film is fusion-bonded to the surface fastener;

in the second region the fastening elements are overlaid with the fusion-bondable film and the fusion-bondable film is not fusion-bonded to the surface fastener;

in the third region the fastening elements are not overlaid with the fusion-bondable film; and the first region and the second region form a fusion-bondable area, comprising:

fixing the first adherend to the first region and the second region of the first fusion-bondable surface fastener, while allowing the third region of the first fusion-bondable surface fastener to project from the edge of the first fusion-bondable surface fastener;

fixing the second adherend to the second fusion-bondable surface fastener, wherein the second fusion-bondable surface fastener has fastening elements co-operating with the fastening elements of the third region; and engaging the fastening elements of the second surface fastener with the fastening elements of the third region.

* * * * *

UNITED STATES PATENT AND TRADEMARK OFFICE

CERTIFICATE OF CORRECTION

PATENT NO. : 8,381,370 B2
APPLICATION NO. : 12/738915
DATED : February 26, 2013
INVENTOR(S) : Higashinaka et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 249 days.

Signed and Sealed this
First Day of September, 2015

Michelle K. Lee

Michelle K. Lee
*Director of the United States Patent and Trademark Office*